US006780018B1

(12) United States Patent
Shipe

(10) Patent No.: US 6,780,018 B1
(45) Date of Patent: Aug. 24, 2004

(54) ELECTRICAL CONNECTOR WITH POWER MODULE

(75) Inventor: Joanne E. Shipe, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/620,075

(22) Filed: Jul. 14, 2003

(51) Int. Cl.[7] ..... H01R 24/00
(52) U.S. Cl. ..... 434/636; 439/907
(58) Field of Search ..... 439/629–637, 439/639, 907

(56) References Cited

U.S. PATENT DOCUMENTS 4,677,527 A * 6/1987 Pasterchick et al. ..... 361/737
4,897,054 A * 1/1990 Gilissen et al. ..... 439/631
5,024,609 A * 6/1991 Piorunneck ..... 439/637
5,316,496 A * 5/1994 Imai ..... 439/495
5,584,728 A * 12/1996 Cheng ..... 439/637
5,919,049 A * 7/1999 Petersen et al. ..... 439/60
6,254,435 B1 7/2001 Cheong et al.
6,402,542 B1 * 6/2002 Jones ..... 439/404

* cited by examiner

*Primary Examiner*—Ross Gushi
(74) *Attorney, Agent, or Firm*—Wei Te Chung

(57) ABSTRACT

An electrical connector (1, 1') includes an elongate dielectric housing (2, 2') defining a slot (200, 200') along a longitudinal direction thereof and a receiving cavity (2210, 74) therein, a number of first contacts (3, 3') retained in the housing and a second contact (4, 4', 8) retained in the housing. The first contact includes a contact portion (30, 30') extending into the slot for engaging with an electronic card (5). The second contact includes a first engaging portion (420, 420', 800) extending into the slot for engaging with the electronic card and a second engaging portion (44, 44', 82) received in the receiving cavity for electrically connecting to a complementary component.

13 Claims, 8 Drawing Sheets

ELECTRICAL CONNECTOR WITH POWER MODULE

CROSS-REFERENCE TO RELATED APPLICATIONS

Relevant subject matter is disclosed in co-pending U.S. patent application entitled "ELECTRICAL CONNECTOR WITH SHOCK SUPPORT", which is assigned to the same assignee with this application.

BACKGROUND OF THE INVENTION

1. Field of the Invention

The present invention relates to an electrical connector, and particularly to an edge card connector with a power module for delivering power from a power supply to an electronic card thereof.

2. Description of Related Art

Edge card connectors, such as Peripheral Component Interconnect (PCI) connectors are widely used in the computer industry ranging from servers to workstations, personal computers (PCs), laptop PCs and mobile devices. PCI connectors establish a high-performance I/O interconnection between a Central processing unit (CPU) and its peripherals to transfer data therebetween.

PCI Express is a newly developed serial I/O technology compatible with the current PCI software environment that offers low-cost, scalable performance for the next generation of computing and communications platforms. In recent days, PCI Express connectors according to the PCI Express standard are designed to achieve a perfectly high-performance interconnection between two electronic devices, such as a mother printed circuit board and a graphics card.

A conventional PCI Express connector comprises an elongated dielectric housing defining a card slot for receiving a graphics card therein. However, due to external forces from shock, the connector, located on a mother printed circuit board, does not have sidewalls strong enough to support the inserted graphics card. U.S. Pat. No. 6,254,435, issued to Cheong et al., discloses an edge card connector comprising a dielectric housing having a card slot along a longitudinal direction thereof and a pair of upright supports at opposite ends of the slot to support an inserted card.

On the other hand, the PCI Express connector is desired to have power contacts for delivering power to some cards such as graphics cards. The power contacts have solder tails electrically connecting to the mother printed circuit board to deliver power from the mother printed circuit board to the graphics card. However, the mother printed circuit board would require a change to have more layers for electrically connecting with the solder tails of the power contacts, thereby increasing the manufacturing cost.

To address the problem of adding the layers to the mother printed circuit board, a cable solution is used to deliver power to the graphics card. Conventionally, a graphics card is equipped with a power connector to engage with a cable end connector which is connected to a power supply. After the graphics card is received in the card slot of the connector, the cable end connector then engages with the power connector on the graphics card. However, when the graphics card is required to changeover, the cable end connector must unplug from an old graphics card and then plug into a new graphic card prior to the insertion of the new card into the card slot of the connector. Accordingly, the cable solution of this type adds complexity for users to changeover the graphics cards.

Hence, an edge card connector having a power module is required to solve above-mentioned problems.

SUMMARY OF THE INVENTION

Accordingly, a first object of the present invention is to provide an edge card connector having the function of power transmission and shock support.

A second object of the present invention is to provide an edge card connector having a power module with power contacts for electrically connecting to a cable end connector.

In order to achieve the objects set forth, an electrical connector in accordance with one embodiment of the present invention comprises an elongate dielectric housing including a base and a tower at one end of the base, a plurality of first contacts retained in the base and a second contact retained in the tower. The base defines a slot extending into the tower along a longitudinal direction thereof. The tower defines a receiving cavity therein. The first contact comprises a contact portion extending into the slot for engaging with an electronic card. The second contact comprises a first engaging portion extending into the slot for engaging with the electronic card, and a second engaging portion received in the receiving cavity for electrically connecting to a complementary component.

An electrical connector in accordance with another embodiment of the present invention comprises an elongate dielectric housing defining a first slot along a longitudinal direction thereof, a plurality of first contacts retained in the housing, and a contact module secured to the housing. The first contact includes a contact portion extending into the first slot for engaging with an electronic card. The contact module comprises a dielectric body and a second contact retained in the dielectric body. The dielectric body defines a second slot having a width substantially the same as that of the first slot. The second contact includes a first engaging portion extending into the second slot for engaging with the electronic card and a second engaging portion for electrically connecting to a complementary component.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
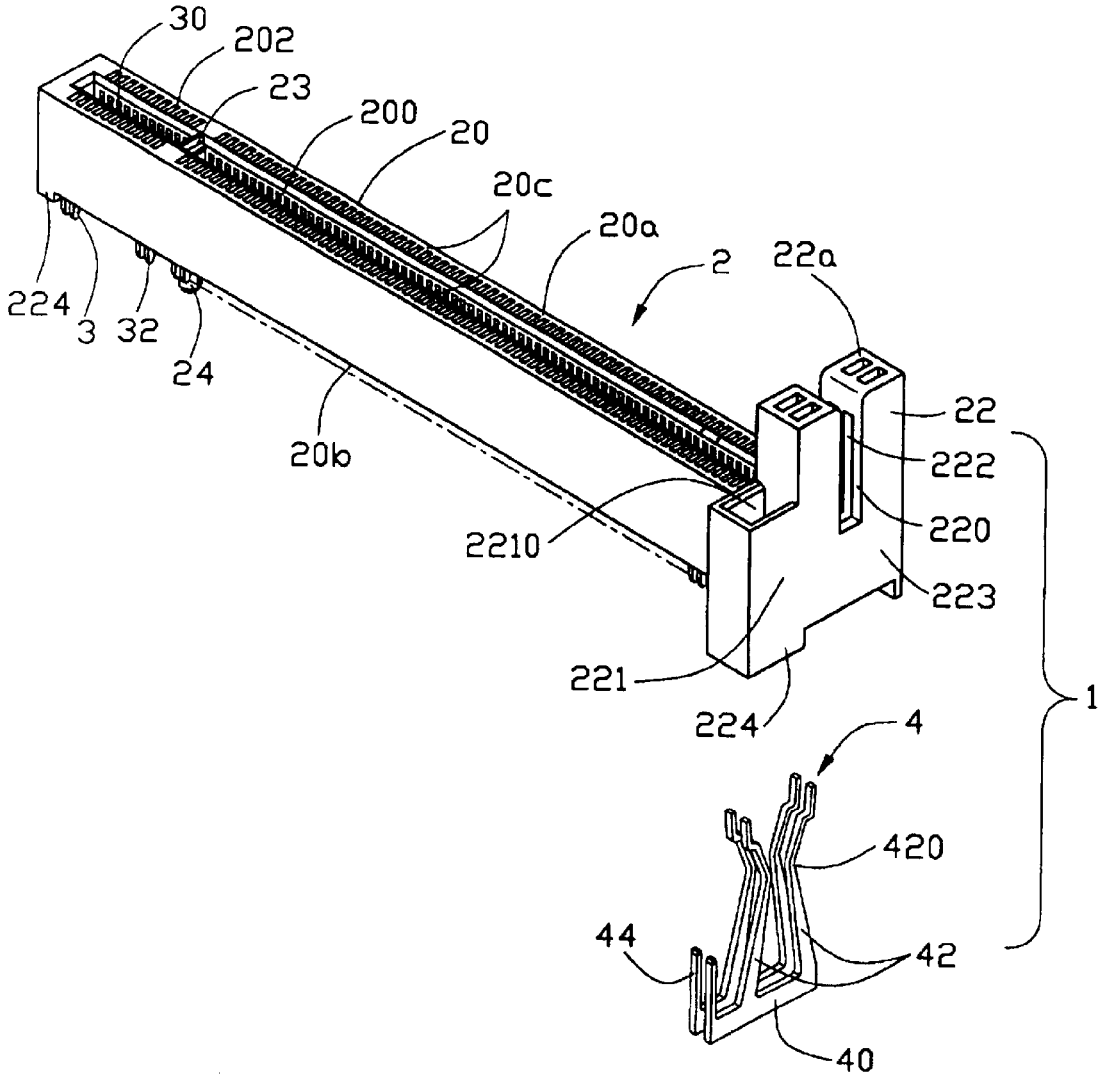
FIG. 1 is a perspective view of an electrical connector in accordance with a first embodiment of the present invention showing a pair of power contacts disassembled with a dielectric housing thereof.
Figure 2:
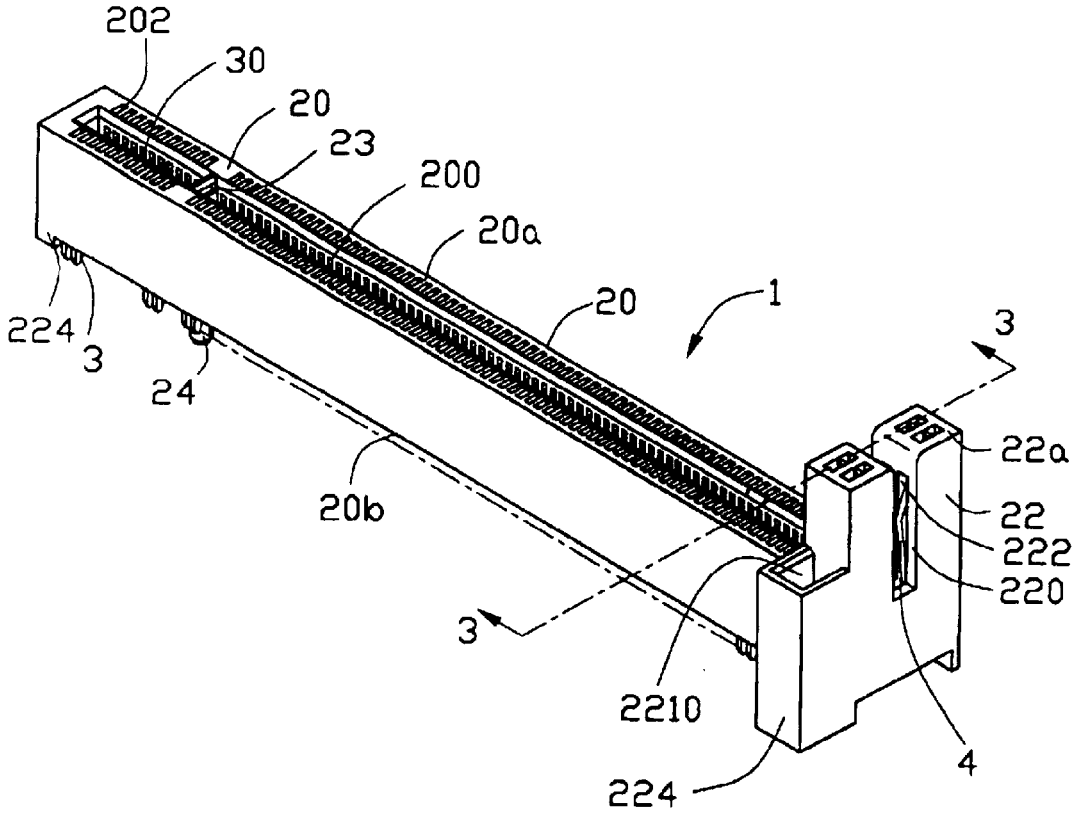
FIG. 2 is a perspective view of the electrical connector showing the power contacts assembled with the dielectric housing thereof.

Referring to FIGS. 1 and 2, an electrical connector 1 in accordance with a first embodiment of the present invention comprises an elongate dielectric housing 2, a plurality of signal contacts 3 retained in the housing 2 for signal transmission, and a pair of power contacts 4 retained in the housing 2 for power transmission.

Figure 3:
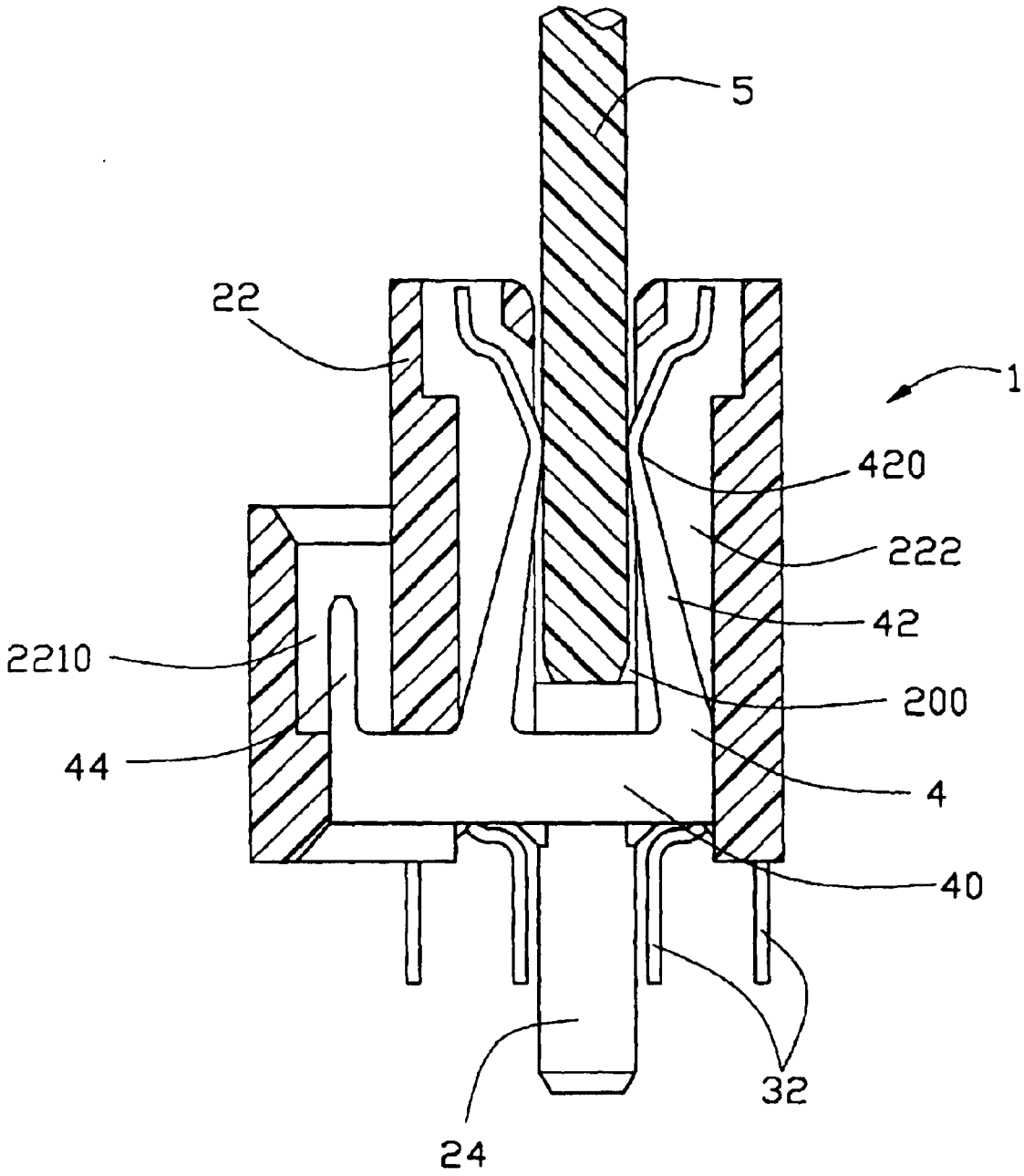
FIG. 3 is a cross-sectional view of the electrical connector taken along line 3—3 in FIG. 2.
Figure 4:
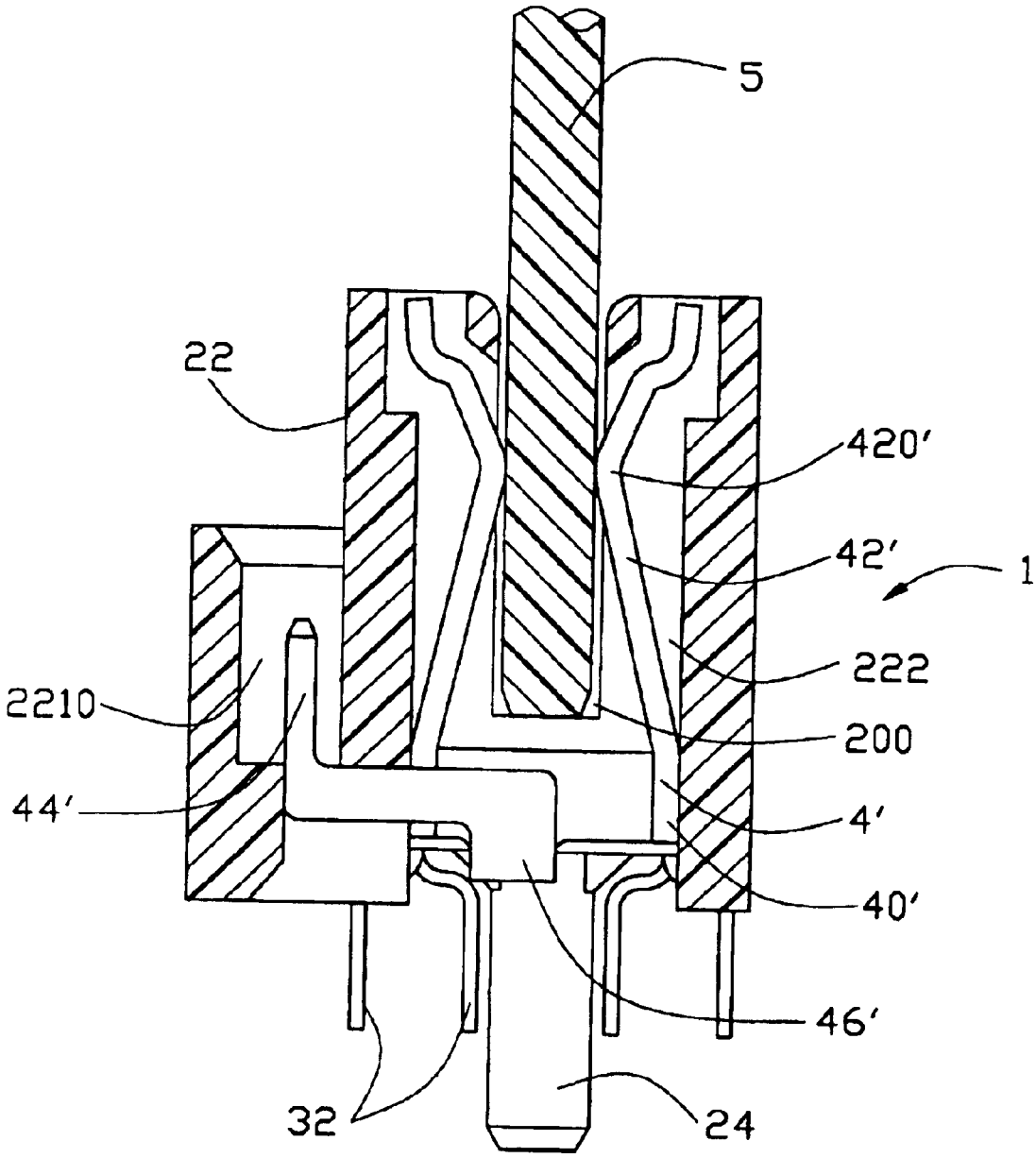
FIG. 4 is a cross-sectional view showing a power contact in accordance with a second embodiment of the present invention received in the dielectric housing.

Referring to FIGS. 3–4 in conjunction with FIGS. 1–2, the dielectric housing 2 includes a base 20 and a tower 22 at one end of the base 20. The base 20 defines a slot 200 in a top mating face 20*a* along a longitudinal direction for receiving a mating edge of an electronic card 5 (schematically shown in FIGS. 3 and 4), and a plurality of first passageways 202 spaced apart along opposite sidewalls 20*c* of the slot 200. Each first passageway 202 communicates with the slot 200.

The slot 200 extends into the tower 22 at one end thereof to form a channel 220 in a top face 22*a* of the tower 22 for supporting the card 5, and a pair of second passageways 222 in a bottom mounting face 20*b* communicating with the slot 200. The tower 22 is separated into first and second supporting portions 221, 223 by the slot 200. The first supporting portion 221 has a larger width than that of the second supporting portion 223 along a lateral direction thereof. The first supporting portion 221 defines a receiving cavity 2210 penetrating through the bottom face 20*b*. The receiving cavity 2210 may or may not communicate with the second passageways 222 in the lateral direction as respectively shown in FIGS. 3 and 4.

The housing 2 is formed with a rib 23 in the slot 200. The rib 23 provides multiple functions such as supporting the sidewalls 20*c* as well as providing polarization for the card 5. A plurality of standoffs 224 project downwardly from the bottom face 20*b* of the housing 2 at a predetermined distance to space the housing 2 from a mother printed circuit board (not shown) upon placement thereon. A positioning post 24 extends downwardly from the bottom face 20*b* of the housing 2 for positioning the connector 1 on the mother printed circuit board.

The signal contacts 3 are received in the first passageways 202 of the housing 2. Each signal contact 3 includes a contact portion 30 extending into the slot 200 for electrically engaging with the mating edge of the card 5, and a solder portion 32 extending downwardly beyond the bottom face 20*b* of the housing 2 for electrically connecting to the mother printed circuit board.

The pair of power contacts 4 are received in the second passageways 222 of the housing 2. Each power contact 4 is planar and includes a retention portion 40 having an interferential engagement with the tower 22 in a corresponding second passageway 222, a pair of mating arms 42 extending upwardly from the retention portion 40 with first engaging portions 420 thereof projecting into the slot 200 for electrically contacting with the mating edge of the card 5, and a second engaging portion 44 extending upwardly from the retention portion 40 to be received in the cavity 2210 for connecting to a cable end connector (not shown). It is noted that the power contact 4 can be modified to have a tail portion just for holding the connector 1 on the mother printed circuit board without any electrical connection therebetween.

Figure 5:
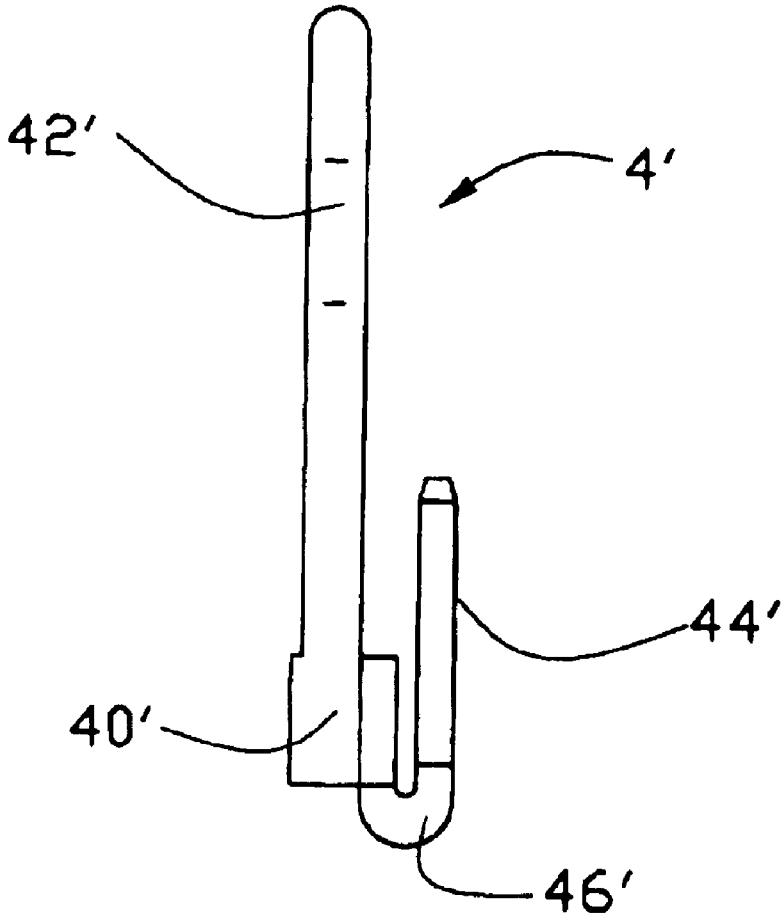
FIG. 5 is a side view of the power contact shown in FIG. 4.

FIGS. 4 and 5 show a power contact 4' in accordance with a second embodiment of the present invention. The power contact 4' includes a retention portion 40' having an interferential engagement with the tower 22 in a corresponding second passageway 222, a pair of mating arms 42' extending upwardly from the retention portion 40' with first engaging portions 420' thereof projecting into the slot 200 for electrically contacting with the mating edge of the card 5, a second engaging portion 44' received in the receiving cavity 2210 for electrically connecting to the cable end connector, and a connecting portion 46' connecting the second engaging portion 44' with the retention portion 40'. The second engaging portion 44' extends in a same direction as the mating arms 42' and offsets from the mating arms 42' along the longitudinal direction of the housing 2.

It is noted that the first engaging portions 420, 420' of the power contacts 4, 4' can also function as a retaining device for resiliently retaining the card 5 in its position.

Figure 6:
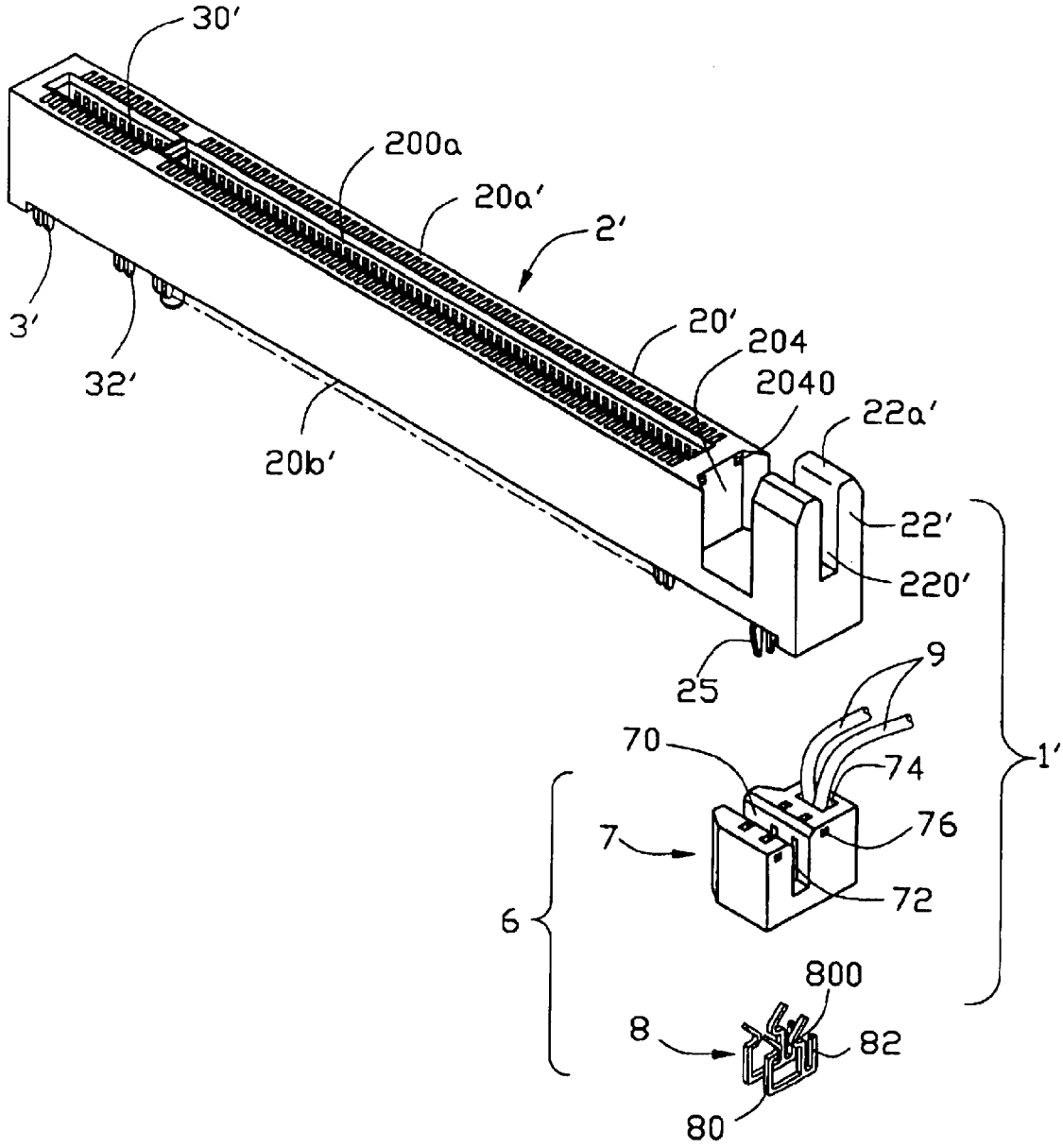
FIG. 6 is a perspective view of an electrical connector with a power module in accordance with a third embodiment of the present invention.
Figure 7:
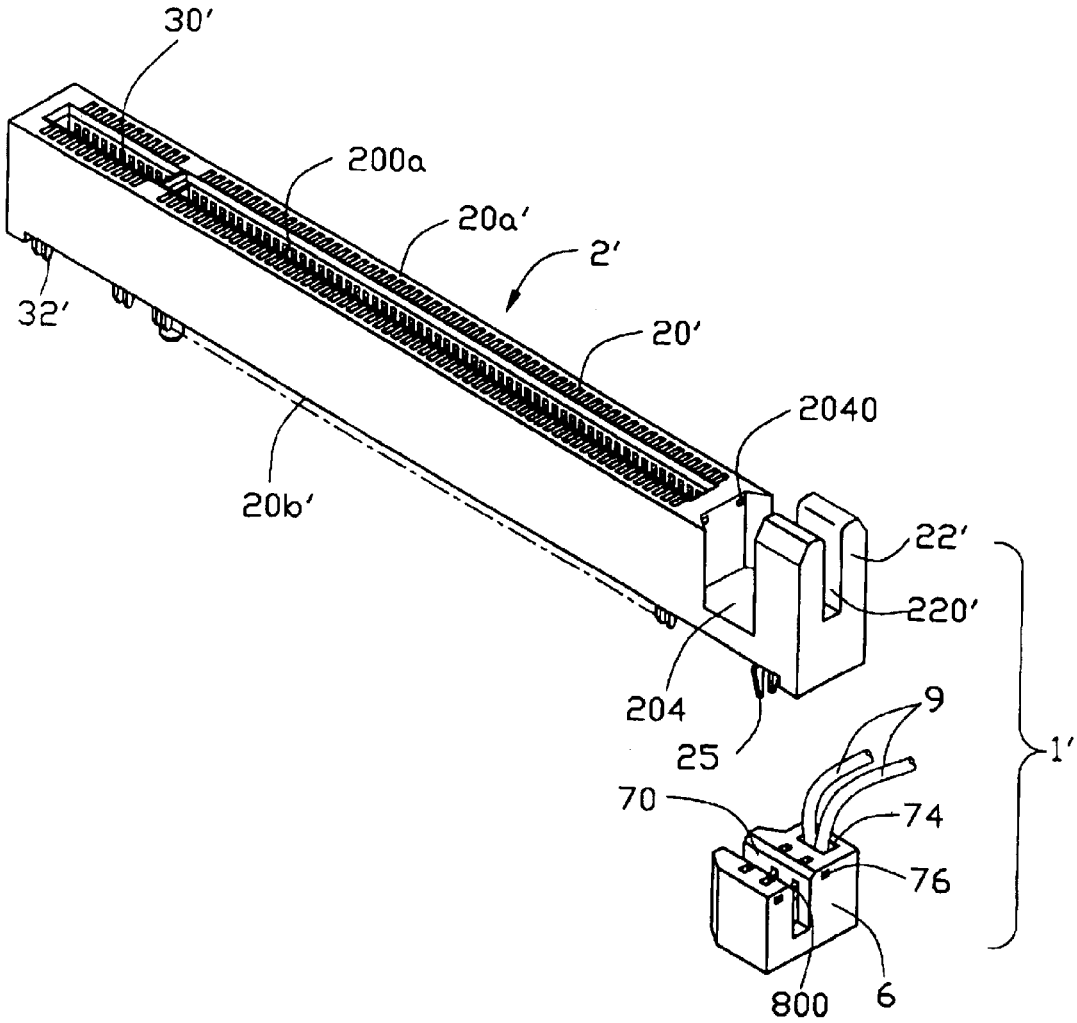
FIG. 7 is a perspective view of the electrical connector showing a pair of power contacts retained in a dielectric body of the power module.
Figure 8:
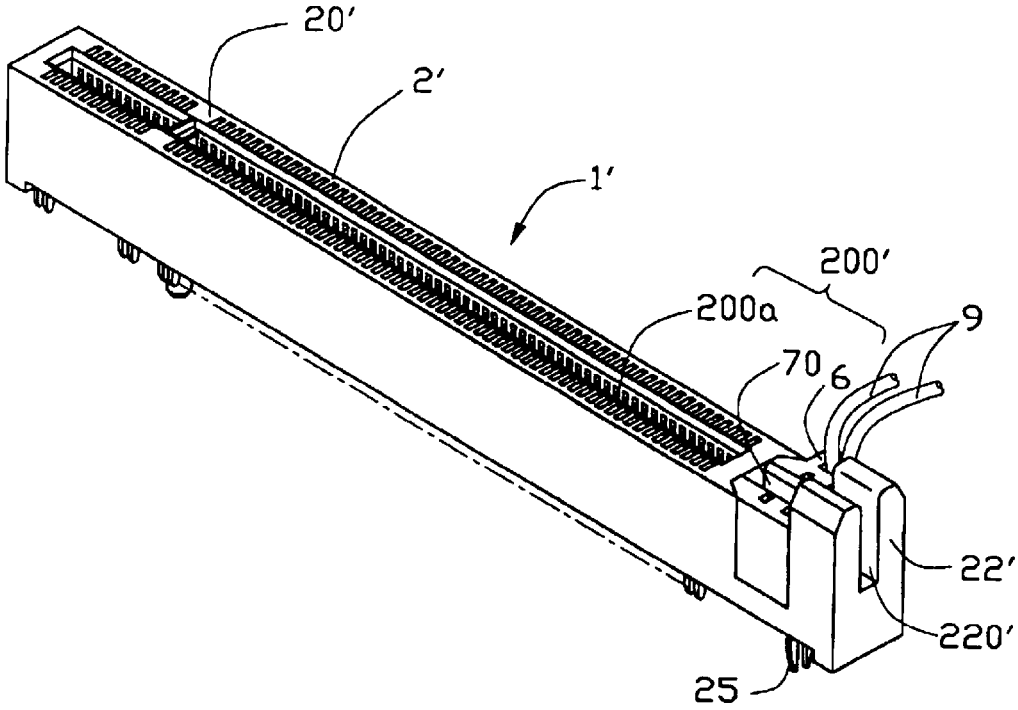
FIG. 8 is an assembled view showing the power module secured in a dielectric housing of FIG. 6.

Referring to FIGS. 6–8, an electrical connector 1' in accordance with a third embodiment of the present invention comprises an elongate dielectric housing 2', a plurality of signal contacts 3' retained in the housing 2' and a power module 6 secured to the housing 2'.

The housing 2' includes a base 20' and a tower 22' at one end of the base 20'. The base 20' defines a first slot 200*a* in a mating face 20*a'* along a longitudinal direction for receiving the mating edge of the card 5 and a chamber 204 in the mating face 20*a'* for accommodating the power module 6. The tower 22' defines a channel 220' in a top face 22a' communicating with the chamber 204 for supporting the card 5. The housing 2' is formed with a plurality of projections 2040 in the chamber 204.

Each signal contact 3' includes a contact portion 30' projecting into the first slot 200*a* for electrically contacting with the mating edge of the card 5, and a solder tail 32' extending downwardly beyond a bottom mounting face 20*b'* of the housing 2' for electrically connecting to the mother printed circuit board.

The power module 6 comprises a dielectric body 7, a pair of power contacts 8 retained in the body 7 and a pair of cables 9 electrically connecting with corresponding power contacts 8. The body 7 defines a second slot 70 having a width substantially the same as that of the first slot 200*a*, a pair of passageways 72 communicating with the second slot 70, and a receiving cavity 74 beside the second slot 70 penetrating through top and bottom faces thereof. The body 7 defines a plurality of recesses 76 therein. Each power contact 8 includes a pair of mating arms 80 with first engaging portions 800 projecting into the second slot 70, and a second engaging portion 82 received in the cavity 74. The second engaging portions 82 electrically connect with the cables 9 which is connected to a power supply (not shown) by variant connecting means, such as soldering, insulation displacement contact (IDC), crimp and so on.

When the power module 6 is received in the chamber 204 of the housing 2', the projections 2040 of the housing 2' snap into the recesses 76 of the body 7 to thereby secure the power module 6 in the housing 2'. The second slot 70 is in alignment with the first slot 200*a* to together form a slot 200' for receiving the mating edge of the card 5. It is noted that the tower 22' provides a downward extending hold down 25 for reliably holding the connector 1' on the mother printed circuit board.

The second engaging portions 44, 44', 82 of the power contacts 4, 4', 8 are configured to electrically connect with the cable end connector or the cables 9 which are connected to the power supply. When the card 5 is inserted into the slot 200, 200' of the connector 1, 1' which is mounted on the mother printed circuit board, the contact portions 30, 30' of the signal contacts 3, 3' contact with signal pads on the mating edge of the card 5 to transmit signal between the card 5 and the mother printed circuit board. The first engaging portions 420, 420', 800 of the power contacts 4, 4', 8 contact with power pads on the mating edge of the card 5 to power from the power supply to the card 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for engaging with an electronic card, comprising:

an elongate dielectric housing defining a slot along a longitudinal direction thereof, the housing comprising a base and a tower at one end of the base, the slot extending into the tower to separate the tower into first and second supporting portions, the first supporting portion having a larger dimension than that of the second supporting portion and defining a receiving cavity;

a plurality of first contacts retained in the housing, the first contact comprising a contact portion extending into the slot for engaging with the electronic card; and a second contact retained in the tower, the second contact comprising a first engaging portion extending into the slot for engaging with the electronic card and a second engaging portion received in the receiving cavity adapted for electrically connecting to a complementary component.

2. The electrical connector as claimed in claim 1, wherein the second contact is generally of a planar shape and comprises a retention portion connecting the first engaging portion with the second engaging portion.

3. The electrical connector as claimed in claim 2, wherein the first engaging portion comprises a pair of mating arms extending upwardly from the retention portion, and the second engaging portion extends from the retention portion in a same direction as the mating arms.

4. The electrical connector as claimed in claim 1, wherein the first engaging portion comprises a pair of upwardly extending mating arms, and the second engaging portion extends in a same direction as the mating arms and offsets from the mating arms in the longitudinal direction of the housing.

5. The electrical connector as claimed in claim 1, wherein the second contact is a power contact.

6. An electrical connector for engaging with an electronic card, comprising:

an elongate dielectric housing defining a first slot along a longitudinal direction thereof, the housing comprising a tower at one end thereof, the tower defining a channel for retaining the electronic card;

a plurality of first contacts retained in the housing and each comprising a contact portion extending into the first slot for engaging with the electronic card; and a contact module secured to the dielectric housing, the contact module comprising a dielectric body and a second contact retained in the dielectric body, the dielectric body defining a second slot having a width substantially the same as that of the first slot, the second contact comprising a first engaging portion extending into the second slot for engaging with the electronic card and a second engaging portion for electrically connecting to a complementary component.

7. The electrical connector as claimed in claim 6, wherein the dielectric housing defines a chamber communicating with the channel, and the contact module is secured in the chamber.

8. The electrical connector as claimed in claim 7, wherein the first and the second engaging portions of the second contact extend in a same direction.

9. The electrical connector as claimed in claim 8, wherein the second contact is a power contact.

10. A card edge electrical connector for use with a daughter board, comprising:

an insulative housing assembly defining along a lengthwise direction thereof a first longer central slot section and a second shorter central slot section spaced from said first longer central slot section in said lengthwise direction;

a plurality of first contacts including contacting portions located on two sides of the first central slot for mechanical and electrical engagement with a first region of the daughter board; and a plurality of second contacts including contacting portions located on two sides of the second central slot for mechanical and electrical engagement with a second region of the daughter board which is spaced from the first region; wherein each of the first contacts include a soldering section for mounting to a printed circuit board on which the housing assembly is seated, while each of the second contacts includes a tail portion which is configured not to be engaged with the printed circuit board but electrical connected to another discrete electronic component via a wire.

11. The electrical connector as claimed in claim 10, wherein said housing assembly includes a discrete module attached to a main body of the housing assembly, and the second central slot section is provided by said discrete module.

12. The electrical connector as claimed in claim 10, wherein said second central slot section is larger than said first central slot section in a lateral direction, which is perpendicular to said lengthwise direction, for further reception of the tail of the corresponding second contact.

13. The electrical connector as claimed in claim 12, wherein the tail of each of said second contacts is located offset from the corresponding contacting portion along said lateral direction.

* * * * *